US005446336A

United States Patent [19]

Gleixner et al.

[11] Patent Number: 5,446,336

[45] Date of Patent: Aug. 29, 1995

[54] EXPLOSION-PROTECTED HIGH-PRESSURE DISCHARGE LAMP

[75] Inventors: Karl-Heinz Gleixner, München; Ulrich Henger, Wipperfürth, both of Germany

[73] Assignee: Patent-Treuhand-Gesellschaft F. Elektrische Gluehlampen mbH, Munich, Germany

[21] Appl. No.: 101,181

[22] Filed: Aug. 3, 1993

[30] Foreign Application Priority Data

Sep. 15, 1992 [DE] Germany ..... 42 30 814.3

[51] Int. Cl.[6] ..... H01J 61/00

[52] U.S. Cl. ..... 313/25; 313/261; 313/292

[58] Field of Search ..... 313/25, 26, 261, 292, 313/624, 625, 634; 445/23, 26, 44

[56] References Cited

U.S. PATENT DOCUMENTS

| | | | |
|---|---|---|---|
| 4,401,913 | 8/1983 | Koza et al. | 313/26 |
| 4,665,344 | 5/1987 | Kajihara et al. | 313/624 |
| 4,839,565 | 6/1989 | Osteen | 313/26 |
| 4,866,327 | 9/1989 | Fischer et al. | 313/25 |
| 4,975,620 | 12/1990 | Masui et al. | 313/624 |
| 5,023,506 | 6/1991 | Canale et al. . | |
| 5,039,912 | 8/1991 | Van Vliet et al. | 313/25 |
| 5,075,586 | 12/1991 | Jaeger et al. . | |

*Primary Examiner*—Sandra L. O'Shea
*Assistant Examiner*—Vip Patel
*Attorney, Agent, or Firm*—Frishauf, Holtz, Goodman & Woodward

[57] ABSTRACT

To facilitate manufacture and assembly of a high-pressure discharge lamp having an inner discharge vessel (4) within an outer bulb (1), and which is protected against explosion or bursting of the discharge vessel by a protective sleeve or body (8), typically formed of two sleeves or tubes (8*a*, 8*b*) of quartz glass or hard glass, the two glass tubes surround the discharge vessel (4) over its entire coaxial length and, when coated with an infrared (IR) reflective coating and an ultraviolet (UV) radiation coating, additionally function as a heat retention or heat damming element and a UV radiation protective element. Two ceramic insulating centering and holding elements are carried by a lamp holder structure (9), engaging the open ends of the glass tubes (8*a*, 8*a*). The ceramic elements are formed with steps (20*a*, 20*b*, 20*c*) or grooves (520*a*, 520*b*) to position the glass tubes spaced from each other and concentric with respect to the discharge vessel. Openings (13, 513) in the ceramic elements permit passage of the connecting leads (6) to the discharge vessel (4). The ceramic elements can be cruciform, star or spider-shaped, or ring-shaped with an apertured web or a transverse rib (19), to provide for pneumatic communication to the interior of the protective body (8) and easy evacuation of the outer bulb (1).

27 Claims, 5 Drawing Sheets

EXPLOSION-PROTECTED HIGH-PRESSURE DISCHARGE LAMP

Reference to related patent, assigned to the assignee of the present application, the disclosure of which is hereby incorporated by reference: U.S. Pat. No. 5,075,586, Jaeger et al.

Reference to related application, assigned to the assignee of the present application, the disclosure of which is hereby incorporated by reference: U.S. Ser. No. 08/101,180, filed Aug. 3, 1993, GLEIXNER.

Reference to related patent, the disclosure of which is hereby incorporated by reference: U.S. Pat. No. 5,023,506, Canale et al.

1. Field of the Invention

The present invention relates to a high-pressure discharge lamp, and more particularly to a high-pressure discharge lamp in which a discharge vessel is located within an outer bulb, to thereby form a dual-envelope bulb, and especially to such a bulb which contains an inner containment or protective body to prevent rupture of the outer bulb in case the discharge vessel should burst.

2. Background

Lamps of the type to which the present invention relates are often used in open fixtures or luminates. The discharge vessel of these lamps, in operation, is under high pressure, and it is therefore necessary to have safety arrangements in case the discharge vessel should burst. It has been proposed—see the referenced Canale et al U.S. Pat. No. 5,023,506—to use a light-transmissive protective sleeve or tube within the outer bulb, surrounding the discharge vessel together with end caps, to provide a containment structure, which prevents impingement of slivers, splinters or glass shards from the discharge vessel in case of explosion of the discharge vessels. The splinters, shards or the like might destroy the outer bulb and cause damage.

The lamp of the referenced Canale et al U.S. Pat. No. 5,023,506 has a double-ended discharge vessel of quartz glass located within an outer bulb and surrounded, throughout its entire length, by a light-transmissive protective sleeve or containment sleeve. This containment sleeve is formed by two coaxial glass tubes, the ends of which are closed off by disk-shaped metallic end caps. The end caps prevent the escape of shards in case the discharge vessel should burst from the containment area, and protect the outer bulb.

The metallic end caps of this construction cause problems in electrical insulation and the effects of photoelectrons. Photoelectrons are generated by the ultraviolet (UV) radiation arising during the discharge. These photoelectrons are emitted from the end caps. To prevent undesired effects of the photoelectrons, the end caps are coated with an insulating coating. This is comparatively expensive. The end caps, also, interfere with ready evacuation of the outer bulb.

THE INVENTION

It is an object of the invention to provide a high-pressure discharge lamp, which is operationally compatible with standard lamps, for example as described in the Canale et al patent, and which has a protective body located within an outer bulb, so retained in the bulb that problems in connection with electrical insulation and the effects of UV radiation are effectively avoided.

Briefly, the protective body comprises one or two transparent ,concentric glass sleeves or tubes, at least one of which, preferably, is of quartz glass. The sleeves or tubes have open ends, and they radially surround the discharge vessel essentially throughout its entire length, with clearance. Some clearance is provided between the tubes, if more than one tube is used.

In accordance with a feature of the invention, ceramic centering and holding elements are provided which are retained on a lamp holder structure which holds the discharge vessel in position, the holder structure thus retaining the protective body in position in the lamp.

By making the centering and holding elements of ceramic, typically an industrial ceramic, and retaining the centering and holding elements on the holder structure for the discharge vessel, a lamp arrangement can be provided in which no metallic components are exposed to photoelectrons from the discharge vessel, since the ceramic centering and holding elements can shield the holder structure from UV radiation. Thus, problems in connection with electrical insulation of the energy supply to the discharge vessel and problems in connection with photo ionization in end caps of the centering and holding elements are effectively avoided.

In accordance with a feature of the invention, the ceramic centering and holding elements are so arranged that they shield the current or energy supply connections to the discharge vessel with respect to UV radiation. Preferably, the ceramic holding elements extend transversely with respect to the axis of the lamp, for example in the form of cross ribs or a ring structure with a cross connection. This ensures free communication to the interior of the outer bulb, and to the space in which the discharge vessel is located, so that evacuation of the space within the outer bulb does not cause any problems. Preferably, the protective body has two glass tubes which are fitted in seats formed in the ceramic holding elements, arranged to center the glass tubes in position within the outer bulb in such a manner that the glass tubes do not touch each other. Stepped, ridged or grooved guides for the glass tubes can readily be formed on the ceramic centering and holding elements.

Experiments have shown that open glass tubes forming the protective body provide sufficient protection against bursting or explosion of the discharge vessel. When the discharge vessel bursts, shards and splinters emitted from the open ends of the sleeves forming the protective body no longer have sufficient kinetic energy capable of destroying the outer bulb. The open ends, further, permit ready decompression of any explosive force, and thus lowers the pressure pulse which is transmitted to the outer bulb. Experiments have also shown that even if the protective glass tubes are damaged by shards arising due to an explosion of the glass discharge vessel, no damage will result to the outer bulb. It retains its integrity and remains undamaged. In accordance with a feature of the invention, therefore, end caps on the containment body are not needed and can be dispensed with. It is only necessary to provide a holding and guiding structure for the protective tubes or sleeves.

In accordance with a feature of the invention, the inner glass tube of the protective body not only provides protection against explosion of the discharge vessel but also has the effect of a heat damming or heat retention tube. Heat generated during discharge of the discharge vessel will be retained, and thus the inner protective tube ensures uniform temperature distribution along the discharge vessel. Preferably, the inner glass tube is coated with an infrared (IR) radiation-reflecting coating which, however, is transparent to visible light. This increases the heat retention effect even more. In accordance with a particularly desirable feature of the invention, one of the two glass tubes of the protective body is formed as a filter for UV radiation, for example by incorporating filtering material in the glass itself, so that the protective body is essentially opaque to UV radiation.

DRAWINGS

FIG. 1 is a schematic side view of a first embodiment of a single-based high-pressure discharge lamp in accordance with the present invention;

FIG. 2*a* is a detailed top view of an insulating ceramic holder element, to a different scale;

FIG. 2*b* is a side view of the holder element of FIG. 2*a*, partly in section;

FIG. 2*c* is a bottom view of the holder element of FIG. 2*a;*

FIG. 3*a* is a side view of another embodiment of a holder element;

FIG. 3*b* is a top view of the ceramic holder of FIG. 3*a;*

FIG. 4*a* is a side view of yet another embodiment of a ceramic holder element, partly in section;

FIG. 4*b* is a top view of the ceramic holder of FIG. 4*a*; and

FIG. 5 is a highly schematic cross section of another embodiment of a ceramic centering and holding element.

DETAILED DESCRIPTION

The invention will be described in connection with a single-based high-pressure discharge lamp, using a double-ended discharge vessel or arc tube as an example of the actual light source used in the lamp.

Figure 1:
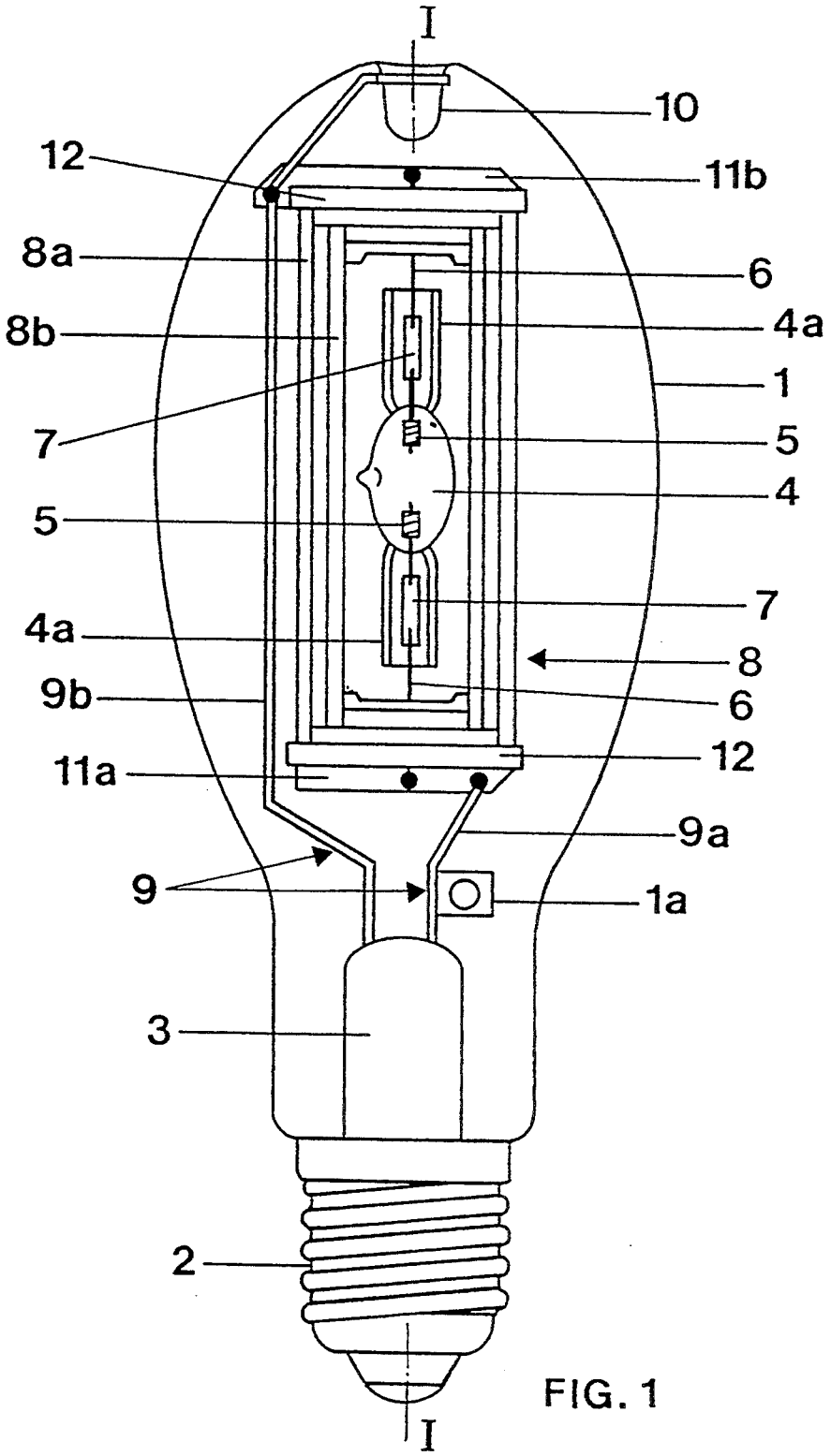

Referring first to FIG. 1:

The lamp has an outer bulb 1, for example a standard bulged tube which is dimpled at one end. The other end of the bulb 1 is connected to a screw base 2, which also retains a lamp mount 3, for example a stem press, or other type of melt seal. A getter 1*a* is located within the outer bulb 1. The light source is an axially arranged discharge vessel 4 of quartz glass, retaining two electrodes 5 and an ionizable fill therein. The electrodes 5 are gas-tightly sealed in the discharge vessel 4, which has two pinch or press seals 4*a*, retaining molybdenum foils 7, to which the electrodes 5 are connected. The external current supply leads 6 from the molybdenum foil extend axially to provide energy supply to the electrodes 5.

The discharge vessel 4 is surrounded essentially throughout its entire length by a cylindrical visible light-transparent double-wall protective body 8. The protective body 8 is formed of two coaxially positioned glass tubes 8*a*, 8*b*, preferably of quartz glass. The outer glass tube 8*a* has an inner diameter of about 22 mm and a length of about 60 mm. The inner glass tube 8*b* has an inner diameter of about 16 mm and a length of about 54 mm. Both glass tubes 8*a*, 8*b* have a wall thickness of about 1.3 mm.

A two-part metallic holder structure 9 is located within the bulb 1. The structure 9 has two metallic connector elements 9*a*, 9*b* which are secured, respectively, in the mount 3 and within a dimple 10 of the bulb 1, forming an inwardly extending projection. The holder further includes transversely extending rib or web elements 11*a*, 11*b* connected, respectively, to the holder structure elements 9*a*, 9*b*. The ribs or webs 11*a*, 11*b* are, respectively, connected by welds to one each of the current supply leads 6 extending from the discharge vessel 4.

In accordance with a feature of the invention, two ceramic holder elements 12 engage the open ends of the glass tubes 8*a*, 8*b* to locate and position the glass tubes in the bulb, and further act as spacers and centering elements for the glass tubes 8*a*, 8*b*. The ceramic holder elements 12 are engaged by the rib or web elements 11*a*, 11*b* forming part of the holder structure 9, for retaining the discharge vessel as well as the protective body 8 formed by the glass tubes 8*a*, 8*b*, in proper position within the outer bulb 1.

Both ceramic holders 12 are identical. They are formed with openings, for example a single opening 13 in the center thereof, that is, coaxial with the axis I—I of the lamp, to permit the lamp current supply leads 6 to pass therethrough. In addition, the ceramic holder elements 12 include a guiding and holding arrangement for the glass tubes 8*a*, 8*b* of the protective body 8. The ceramic holder elements 12 are made of industrial ceramics, and each is formed with a slot-type depression 14 in the surface remote from the protective body 8, to receive respectively a cross rib or cross web 11*a*, 11*b*. The ribs or webs 11*a*, 11*b* are part of a subassembly which includes the discharge vessel or arc tube holder 9, and 9*a*, 9*b*. The ribs or webs 11*a*, 11*b* are made of punched sheet metal, preferably of nickel. The ceramic holder elements 12 are pressed by the ribs 11*a*, 11*b* against the end faces or open ends of the glass tubes 8*a*, 8*b* forming the protective body 8.

The ceramic holder elements may be of various constructions. In a first embodiment, as illustrated in FIGS. 2*a* through 2*c*, the ceramic holder elements include a circular ring 20 with a diametrically extending rib or web 19, extending across the ring 20.

Figure 2A:
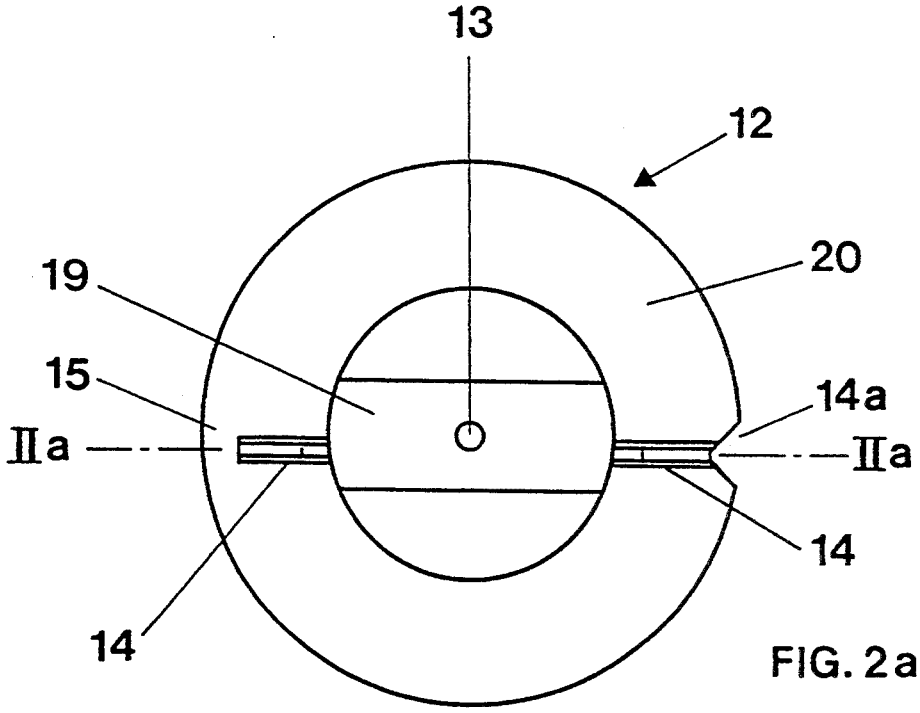
Figure 2B:
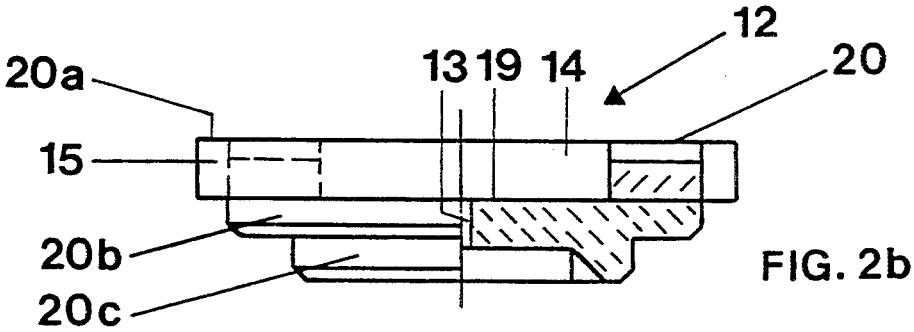
Figure 2C:
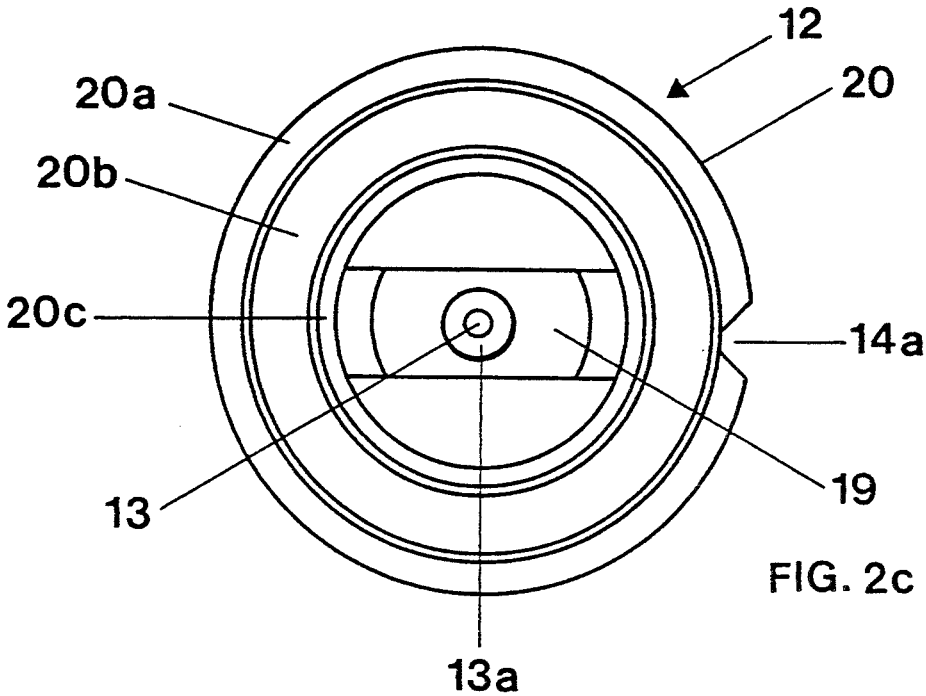

Referring now to FIGS. 2*a*–2*c*, the ring 20 of the ceramic holder 12 is constructed in steps. It has a first step 20*a* (see FIG. 2*b*) with an outer diameter of about 25 mm. The second step 20*b* is a complete circle with an outer diameter of 22 mm. The third and last step 20*c* has an outer diameter of about 15 mm.

The ceramic holder 12 engages the facing end of the outer glass tube 8*a* at its first step 20*a*. The second step 20*b* fits into the open end of the outer glass tube 8*a* and engages against the inner wall of the outer glass tube 8*a*. Additionally, the end face of the second step 20*b* forms an engagement surface for the inner glass tube 8*b*. The third step 20*c* then fits into the open end of the inner glass tube 8*b*. Thus, the glass tubes are centered with respect to the axis I—I of the lamp, and are retained in properly spaced condition with respect to the each other.

The outer diameter of the second and third steps 20*b* and 20*c* of the ring 20 thus are matched to the interior diameter of the glass tubes 8*a*, 8*b*, respectively, so that the entire protective body 8 is centered by the ceramic holder 12. The ceramic holder 12, further, is formed with a central through-bore 13 formed at the bottom with a small countersink 13*a*. The bore 13 is located at the center of the cross rib or web 19 of the holder 9, and receives and guides one of the current supply leads 6 extending from the discharge vessel 4.

The cross rib 19 has a width of about 5 mm and a thickness of about 3 mm, and it is located approximately in the same plane as the second step 20*b*. The overall thickness of the ring 20 is about 6.5 mm. The inner diameter thereof is about 13.5 mm. At the side of the ceramic body remote from the steps to receive the protective body, a slot-like recess 14 for reception of a cross rib or cross web 11*a*, 11*b* is formed on the end face of the ceramic holder 12. The slot 14 is parallel to the rib 19 but not exactly diametrical, i.e. at a chord line, to permit the axial lead 6 from vessel 4 to be centered. The depth of the slot 14 corresponds roughly to the thickness of the first step 20*a* of the ring 20. The length of the slot 14 is so dimensioned that the first step 20*a* of the ring 20 is not separated into two parts by the slot 14, see FIG. 2*b*. A small bridge 15 (FIG. 2*a*) will remain, which effectively prevents electric arc-over between the holder portion 9*b* and the cross rib 11*a* when an ignition or firing voltage pulse is applied to the arc tube 4.

The outer circumference of the ring 20 is indented as shown at 14*a*. When assembling the ceramic holders 12 in the aforementioned subassembly, the bridge 15 of the lower holder 12 is so placed that it faces the upwardly extended holder part 9*b*. The upper ceramic holder 12 can then be so aligned that the notch 14*a* faces the holder part 9*b*.

Figure 3A:
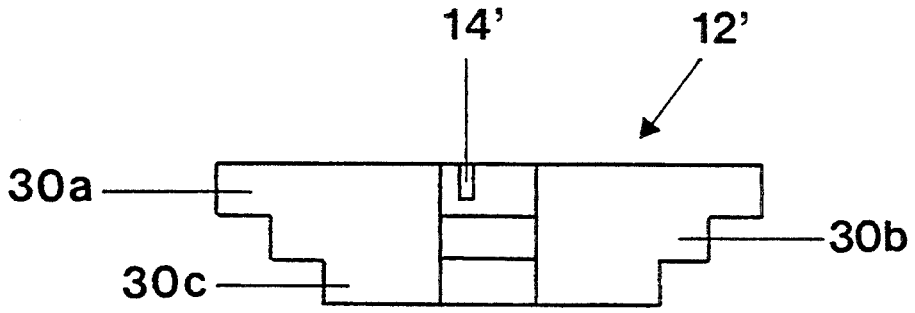
Figure 3B:
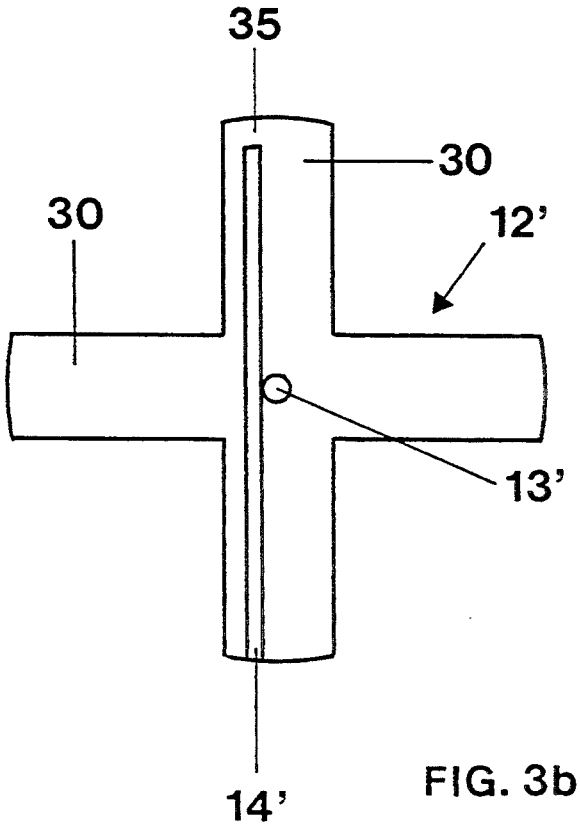

Various forms are possible for the ceramic holder. Referring now to FIGS. 3*a* and 3*b*: The ceramic holder 12' differs from the embodiment in connection with FIGS. 2*a*–2*c* in that the holder 12' is formed in cross shape. In all other respects, the lamp illustrated in FIG. 1 can be constructed without any change. The two cross bars 30 are in one plane, and are located with respect to each other at right angles. Similar to the ring 20, they are formed in three steps. The length of the cross bar 30 of the ceramic holder 12' has in the first, second and third steps 30*a*, 30*b*, 30*c* dimensions of about 25 mm, 22 mm and 15 mm. Similar as in the embodiment above described, ceramic holder 12' engages with the second and third steps 30*b*, 30*c* in interengaging connection between the open ends of the outer and inner glass tubes 8*a*, 8*b* respectively, for centering the glass tubes and holding them apart. The first step 30*a* engages an end face of the outer glass tube 8*a*; the second step 30*b* engages an end of the inner glass tube 8*b*. The two glass tubes 8*a*, 8*b* are retained by the holders 12' with spacing or clearance between each other, so that they do not touch each other.

Both ceramic holders 12' are formed with a central bore 13' through which a current supply lead 6 can be guided.

One of the two cross bars 30 of each ceramic holder 12' is formed with a slot-like depression 14', for engagement with one of the cross ribs or webs 11*a*, 11*b* of the holder 9. These slotted depressions 14' do not extend over the entire length of the respective cross bar 30, leaving an end portion or bridge 35 at that cross bar, to provide insulation against arc-over. The discharge vessel 4 is placed, as described above, and the current supply leads are welded to the respective cross ribs or cross webs 11*a*, 11*b* forming part of the holder 9, to retain the discharge vessel 4 centered within the holder 8.

The slots 14' are not located exactly on center to permit centering of the hole 13', and thus of the discharge vessel 4 with respect to the axis I—I of the lamp.

Figure 4A:
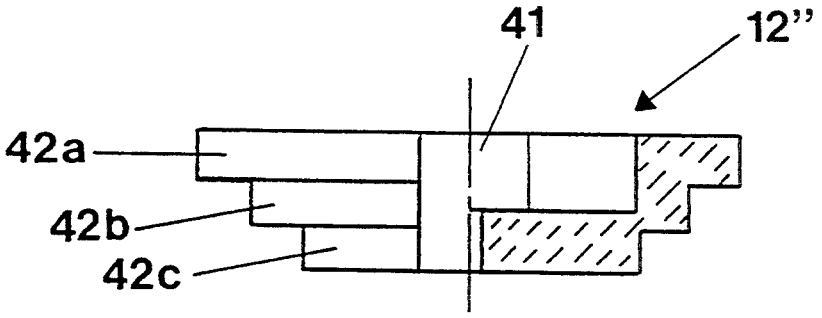
Figure 4B:
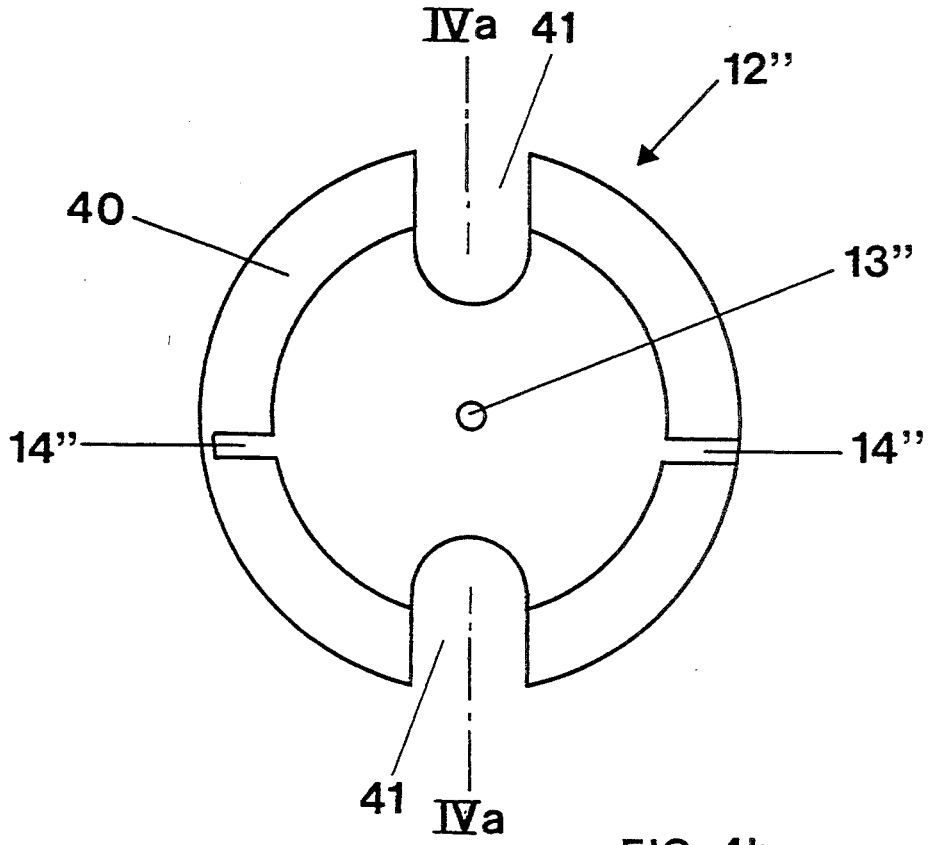

Another form of the holder structure is shown in FIGS. 4*a* and 4*b*. The ceramic holder 12'' forms the only difference in the high-pressure discharge lamp which, in all other respects is identical to that described above. The two ceramic holders 12'' are formed as partly interrupted circular disks. They include the central bore 13'' for a current supply lead 6 extending from the discharge vessel 4. At the upper side, the ceramic holder 12'' is formed with a ring-shaped welt 40, which is interrupted only by two slot-like recesses 14'', to receive the cross ribs or cross webs 11*a*, 11*b* of the discharge vessel holder 9. Additionally, two U-shaped recesses or cut-outs 41 are formed in the disks 12'' which partially interrupt the continuity of the disk-shaped holder. At the bottom side, the disk is formed with three stepped shoulders or abutments 42*a*, 42*b*, 42*c* which, apart from the recesses 41, are circular and have diameters such that the steps 42*b* and 42*c*, respectively, fit around the inner diameter of the outer and the inner glass tube 8*a*, 8*b*, respectively. The diameter of the ceramic holder 12'' at the step 42*a* is about 25 mm.

After assembly, the bottom sides of the stepped abutments 42*a* and 42*b*, respectively, engage the end faces of the outer and the inner glass tube 8*a*, 8*b* respectively. The steps 42*b*, 42*c* fit into the open ends of the outer and the inner glass tubes 8*a*, 8*b* to center the glass tubes and space them from each other. The U-shaped recesses 41 within the holders 12'' are so dimensioned that all hollow spaces of the protective body 8 are in free communication with the inner space of the outer bulb 1 so that no problems arise in connection with evacuation of the bulb 1.

Various other changes and modifications may be made. For example, the ceramic holders 12' need not be in cruciform shape (see FIGS. 3*a*, 3*b*) but, rather, the cross elements can be in star form or Y-shaped. If a Y or spider-like construction is selected, the ribs are preferably spaced by an angle of 120° with respect to each other.

It is also possible to retain the glass tubes 8*a*, 8*b* differently; rather than using stepped abutments, as described above, circular grooves can be formed in the sides of the ceramic holders facing the glass tubes as guide elements therefor.

Figure 5:
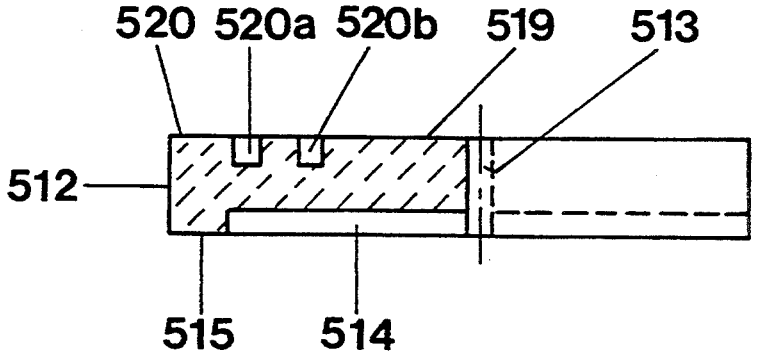

The glass tubes could, for example, be of equal lengths, and retained in grooves of the ceramic holding element. FIG. 5 illustrates such a structure in which a ceramic centering and holding element 512 is shown, highly schematically, in cross section. The top view may be of any suitable form, described above, and for purposes of illustration, the top of FIG. 5, except for the steps, could be similar to the top view of FIG. 2, that is, an outer circular or ring-shaped portion 520 with a cross rib 519. To receive the two glass tubes 8*a*, 8*b*, the structure is formed with two concentric grooves 520*a*, 520*b*. The grooves 520*a*, 520*b* are shown of different depths, although of course they could be of the same depth, or the arrangement of differences in depths could be reversed from that shown in FIG. 5. The web 519 is formed with a through-bore 513 to receive one of the current supply leads 6 from the discharge vessel 4. FIG. 5 also shows the outer insulation bridge 515 and the groove 514 to receive ,one of the webs 11*a*, 11*b*.

The glass tubes, in all embodiments, preferably are of quartz glass. It is not necessary that both glass tubes be made of quartz glass; for example, since the outer glass tube is subjected to a lower thermal loading than the inner glass tube, it is possible to make the outer glass tube 8*a* of hard glass and only the inner one, 8*b*, of quartz glass; or, in some cases, both tubes of hard glass.

The inner or the outer glass tube, in order to improve heat retention and heat damming, can be coated at its inner and/or outer surface with an IR radiation-reflective coating. One of the two glass tubes can also be provided with a UV filter. Such a UV filter can be a coating which either absorbs UV radiation or reflects UV radiation or which is applied as doping to the glass of the respective glass tube to absorb UV radiation, by doping with atoms, ions, or molecules which absorb UV radiation.

For details and descriptions of various features of the holding structure 9a, 9b, 11a, 11b, the reader is directed to the referenced copending application, assigned to the assignee of this application: U.S. Ser. No. 08/101,180, filed Aug. 3, 1993, GLEIXNER.

Various other changes and modifications may be made, and features described in connection with any one of the embodiments may be used with any of the others, within the scope of the inventive concept.

The ceramic holding element 12 preferably is made of aluminum oxide ($Al_2O_3$).

We claim:

1. Explosion-protected high-pressure discharge lamp having a discharge vessel (4) having at least one sealed end, and electrodes (5), and an ionizable fill within the discharge vessel;

current supply leads (6) extending from the at least one sealed end of the discharge vessel (4);

an essentially rotation-symmetrical outer bulb (1) defining a lamp axis (I—I) and at least one base (2) located at an end region of the bulb;

a discharge vessel holder means (9) retaining and holding the discharge vessel (4) in position in the bulb (1), said holder means (9) including two ribs or webs (11a, 11b) extending essentially transversely to the axis (I—I) of the lamp; and a transparent, essentially cylindrical protective body (8) having open ends and radially surrounding the discharge vessel essentially throughout its entire length, and comprising two insulating ceramic centering and holding elements (12, 12', 12''; 512), said insulating ceramic centering and holding elements being retained on the discharge vessel holder means (9) and holding the protective body (8) in position in the lamp; and reception means (14, 14', 14''; 514) formed on each of said ceramic centering and holding elements (12, 12', 12''; 520), dimensioned and positioned to receive said transversely extending ribs or webs (11a, 11b) of the discharge vessel holder means (9).

2. The lamp of claim 1, further including guide means (20a, 20b, 20c; 30a, 30b, 30c; 42a, 42b, 42c; 520a, 520b) formed on the insulating ceramic centering and holding elements (12, 12', 12''; 520) for retaining and guiding the protective body (8) in position in the lamp.

3. The lamp of claim 1, wherein at least one of the ceramic centering and holding elements is formed with a through-bore (13, 13', 13''; 513) to permit passage of the current supply leads (6) from the discharge vessel therethrough.

4. The lamp of claim 1, wherein said ribs or webs (11a, 11b) comprise punched sheet-metal elements.

5. The lamp of claim 1, wherein said ribs or webs are longitudinally spaced from each other by a distance dimensioned to press said ceramic centering and holding elements against end faces of the cylindrical protective body (8).

6. The lamp of claim 1, wherein said ceramic centering and holding elements (12, 512) comprise a ring (20, 520) and a rib or web (19, 519) extending essentially transversely of said ring.

7. The lamp of claim 1, wherein (FIGS. 3a, 3b) said ceramic centering and holding elements (30) comprise an essentially cruciform or star-shaped or spider-shaped structure.

8. The lamp of claim 1, wherein said discharge vessel is a double-ended discharge vessel, and said ceramic holder elements are each formed with one opening (13) located centrally essentially coaxially with the axis (I—I) of the lamp.

9. The lamp of claim 1, wherein (FIGS. 4a, 4b) said ceramic centering and holding elements (40) comprise a circular disk ( 12'').

10. The lamp of claim 9, wherein said circular disk (12'') defines a diametrically extending web, said web being formed with a plurality of openings or apertures (41) therein to provide pneumatic communication between the interior of the bulb (1) and the interior of the cylindrical protective body (8), and hence permit evacuation of the entirety of the free space within the outer bulb (1).

11. The lamp of claim 1, wherein said ceramic centering and holding elements ( 12, 12', 12''; 512) are formed with recesses (14, 14', 14''; 514) in the form of inwardly extending slots at a surface remote from said protective body (8) positioned and dimensioned to receive said ribs or webs (11a, 11b).

12. The lamp of claim 11, wherein said slots (14, 14', 14''; 514) terminate short of an outer end of said ceramic centering and holding elements to leave a bridge (15, 35; 515) of ceramic material to provide insulation material between the rib or web in said slot, and the outer end of the respective centering and holding element.

13. The lamp of claim 1, wherein said protective body (8) comprises two glass tubes or sleeves (8a, 8b), said glass tubes or sleeves coaxially surrounding the discharge vessel (4), and having, respectively, different diameters, and being coaxially received within each other.

14. The lamp of claim 13, wherein the inner one (8b) of the two glass tubes is positioned within the outer one (8a) of the glass tubes with a space therebetween to prevent surface engagement of said two glass tubes.

15. The lamp of claim 13, including an infrared (IR) reflective coating on at least one of said glass tubes or sleeves (8a, 8b).

16. The lamp of claim 13, further including an ultraviolet (UV) filter on, or incorporated in at least one of said glass tubes (8a, 8b).

17. The lamp of claim 16, wherein said UV filter comprises at least one of:

a UV radiation absorbing coating;

a UV radiation reflective coating;

a doping of the respective glass tube with atoms, ions or molecules absorbing UV radiation.

18. The lamp of claim 13, further including guide means (20a, 20b, 20c; 30a, 30b, 30c; 42a, 42b, 42c; 520a, 520b) formed on the ceramic centering and holding elements (12, 12', 12''; 512) for retaining and guiding the protective body (8) in position in the lamp;

and wherein said guide means are dimensioned and shaped to engage respectively the inner diameters of said glass tubes, and receive the outer diameters of the glass tubes, and engage the end faces of said glass tubes.

19. The lamp of claim 18, wherein said guide means (20*a*, 20*b*, 20*c*; 30*a*, 30*b*, 30*c*; 42*a*, 42*b*, 42*c*) (FIGS. 2, 3, 4) comprise steps or stepped abutments engaging within the open ends of the glass tubes and forming engagement and seating surfaces for the end faces of said glass tubes.

20. The lamp of claim 19, wherein said stepped abutments comprise a first step (20*a*, 30*a*, 42*a*) forming an engagement and seating surface for the outermost of said two glass tubes (8*a*);

a second step (20*b*, 30*b*, 42*b*) forming an inner abutment for the open end of the outer glass tube (8*a*) and additionally an end engagement and seating surface for the inner one of the glass tubes (8*b*); and a third step (20*c*, 30*c*, 42*c*) engaging within the inner end of the inner one of the glass tubes (8*b*).

21. The lamp of claim 18, wherein (FIG. 5) said guide means (520*a*, 520*b*) comprise grooves (520*a*, 520*b*) formed at the side of the ceramic centering and holding elements (512) facing said glass tubes, the end faces of the glass tubes engaging within said grooves (520*a*, 520*b*).

22. The lamp of claim 13, wherein both glass tubes (8*a*, 8*b*) comprise quartz glass.

23. The lamp of claim 13, wherein the inner glass tube (8*b*) comprises quartz glass and the outer one of the glass tubes (8*a*) comprises hard glass.

24. The lamp of claim 13, wherein both glass tubes (8*a*, 8*b*) comprise hard glass.

25. The lamp of claim 13, wherein each ceramic centering and holding element comprises a structure including at least one diametrically extending element (19, 20, 30, 40; 519) having a diametrical dimension which is at least as great as the outer diameter of the outer one (8*a*) of said glass tubes (8*a*, 8*b*) of the protective body (8).

26. Explosion-protected high-pressure discharge lamp having a discharge vessel (4) having at least one sealed end, and electrodes (5), and an ionizable fill within the discharge vessel;

current supply leads (6) extending from the at least one sealed end of the discharge vessel (4);

an essentially rotation-symmetrical outer bulb (1) defining a lamp axis (I—I) and at least one base (2) located at an end region of the bulb;

a discharge vessel holder means (9) retaining and holding the discharge vessel (4) in position in the bulb (1); and a transparent, essentially cylindrical protective body (8) having open ends and radially surrounding the discharge vessel essentially throughout its entire length;

said protective body (8) comprising two glass tubes or sleeves (8*a*, 8*b*), said glass tubes or sleeves coaxially surrounding the discharge vessel (4), and having, respectively, different diameters, and being coaxially received within each other, and comprising, two insulating ceramic centering and holding elements (12, 12′, 12″; 512), said insulating ceramic centering and holding elements being retained on the discharge vessel holder means (9) and holding the protective body (8) in position in the lamp;

guide grooves (520*a*, 520*b*) facing said glass tubes formed on the ceramic centering and holding elements (12, 12′, 12″; 512) dimensioned and shaped to engage respectively the inner diameters of said glass tubes, and receive the outer diameters of the glass tubes, and engage the end faces of said glass tubes.

27. The lamp of claim 26, wherein at least one of said glass tubes (8*a*, 8*b*) comprises at least one of quartz glass and hard glass.

* * * * *